US008246305B2

(12) United States Patent
Lecuyer et al.

(10) Patent No.: US 8,246,305 B2
(45) Date of Patent: Aug. 21, 2012

(54) GAS TURBINE ENGINE BALANCING

(75) Inventors: Daniel Lecuyer, Verdun (CA); Bruno Chatelois, Boucherville (CA); Franco Di Paola, Montreal (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 447 days.

(21) Appl. No.: 12/572,031

(22) Filed: Oct. 1, 2009

(65) Prior Publication Data

US 2011/0081253 A1 Apr. 7, 2011

(51) Int. Cl.
*F01D 5/08* (2006.01)
*F01D 5/10* (2006.01)

(52) U.S. Cl. ..... 416/95; 416/96 R; 416/144; 416/145; 416/500; 415/119

(58) Field of Classification Search ..... 415/1, 115, 415/116, 119; 416/1, 95, 96 R, 96 A, 97 R, 416/144, 145, 500
See application file for complete search history.

(56) References Cited

U.S. PATENT DOCUMENTS

| | | | | |
|---|---|---|---|---|
| 2,336,697 | A * | 12/1943 | Moeller | 416/144 |
| 3,297,302 | A | 1/1967 | Spears, Jr. | |
| 4,456,427 | A * | 6/1984 | Evans et al. | 416/95 |
| 4,848,182 | A | 7/1989 | Novotny | |
| 4,898,514 | A | 2/1990 | McCracken | |
| 5,018,943 | A | 5/1991 | Corsmeier et al. | |
| 5,415,526 | A | 5/1995 | Mercadante et al. | |
| 6,302,650 | B1 | 10/2001 | Williams et al. | |
| 6,364,613 | B1 * | 4/2002 | Deallenbach et al. | 415/115 |
| 6,699,015 | B2 | 3/2004 | Villhard | |
| 7,021,898 | B2 | 4/2006 | Elliott et al. | |
| 7,025,570 | B2 | 4/2006 | Jung et al. | |
| 7,063,507 | B2 | 6/2006 | Hsieh | |
| 7,121,801 | B2 | 10/2006 | Surace et al. | |
| 7,270,517 | B2 | 9/2007 | Garner | |
| 7,322,797 | B2 | 1/2008 | Lee et al. | |
| 7,347,672 | B2 | 3/2008 | Bertrand et al. | |
| 2008/0095613 | A1 | 4/2008 | Blanchard et al. | |

* cited by examiner

*Primary Examiner* — Christopher Verdier
(74) *Attorney, Agent, or Firm* — Norton Rose Canada LLP

(57) ABSTRACT

An apparatus and method for balancing a gas turbine engine rotor includes a plurality of balancing weights adapted to be selectively attached to at least one of inlets or outlets of a cooling passage of the rotor. The weights include cooling access which permits coolant to communicate with the cooling passage.

9 Claims, 3 Drawing Sheets

GAS TURBINE ENGINE BALANCING

TECHNICAL FIELD

The subject matter relates generally to gas turbine engines, and more particularly, to balancing a gas turbine engine rotor.

BACKGROUND OF THE ART

A rotor assembly of a gas turbine engine may require balancing, for example, by addition of balancing weights in selected locations of the rotor assembly. Balancing weights are conventionally provided through dedicated attachments points on the rotor. These configurations however, may introduce stress concentrations on the rotor assembly.

Accordingly, there is a need to provide for improved balancing or gas turbine engine rotors.

SUMMARY OF THE INVENTION

In one aspect, the described subject matter provides an apparatus for balancing a gas turbine engine rotor assembly, the apparatus comprising at least one annular balancing weight having a central aperture defined therethough, the at least one weight inserted into a cooling hole defined in the rotor assembly, the at least one balancing weight installed asymmetrically on the rotor assembly to thereby assist in balancing the rotor assembly.

In another aspect, the described subject matter provides a balanced rotor of a method for balancing a gas turbine rotor assembly, the method comprising steps of: (a) providing a rotor assembly having a rotational imbalance, the rotor assembly having a plurality of cooling holes defined therein, the cooling holes communicating with a cooling path through a disc of the rotor assembly; (b) providing at least one balancing weight defining a cooling passage; and (c) inserting the at least one cooling weight into a said cooling hole in a manner which permits cooling air access to the cooling path through said cooling passage of the weight.

Further details of these and other aspects of the described subject matter will be apparent from the detailed description and the drawings included below.

DESCRIPTION OF THE DRAWINGS

Reference is now made to the accompanying drawings depicting aspects of the described subject matter, in which.

DETAILED DESCRIPTION OF THE PREFERRED EMBODIMENTS

Figure 1:
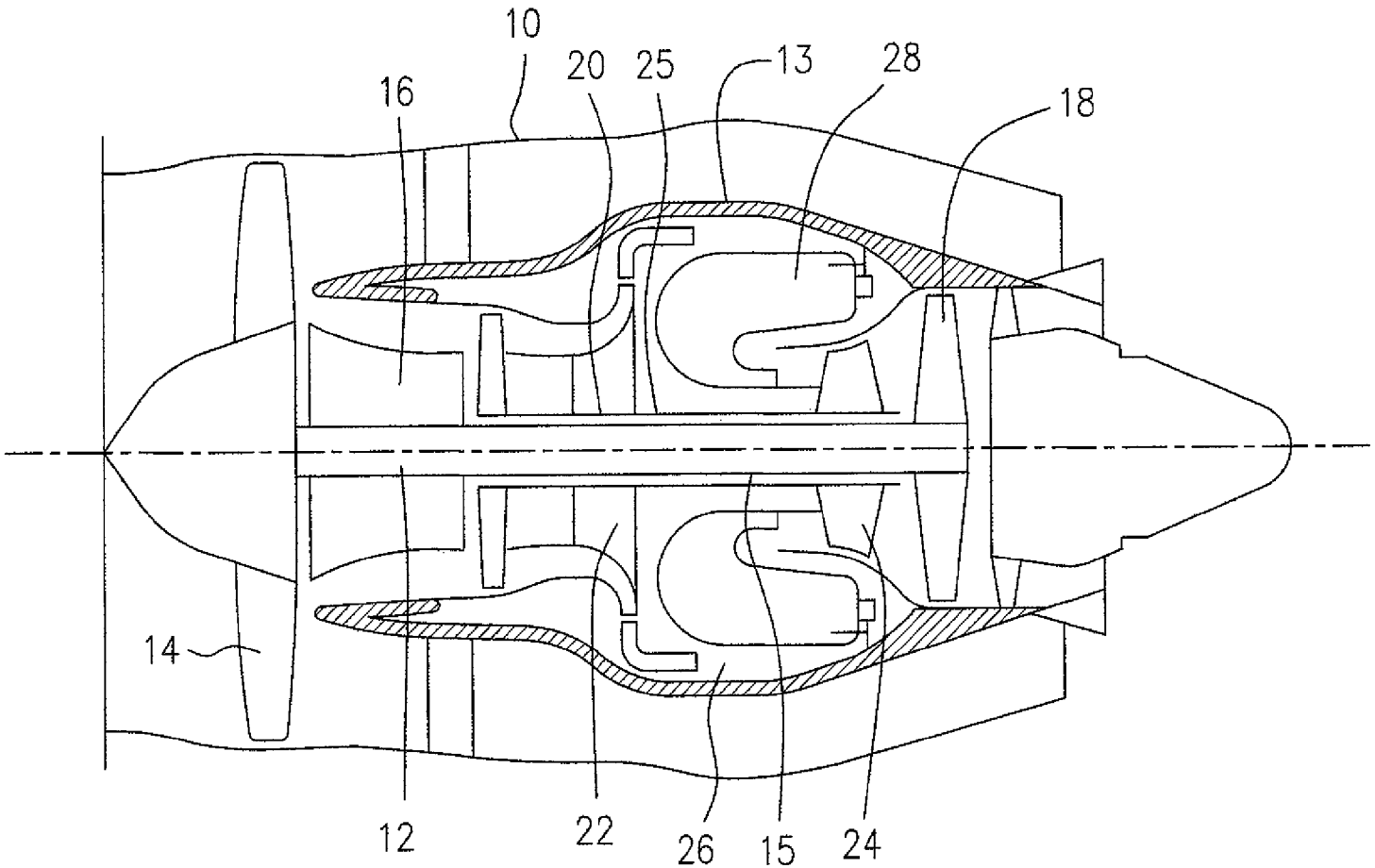
FIG. 1 is a schematic cross-sectional view of a turbofan as an example of a gas turbine engine that could incorporate embodiments of the described subject matter.

Referring to FIG. 1, a turbofan gas turbine engine incorporating an embodiment of the described subject matter is presented as an example of the application of the described subject matter, and includes a housing 10, a core casing 13, a low pressure spool assembly seen generally at 12 which includes a shaft 15 interconnecting a fan assembly 14, a low pressure compressor 16 and a low pressure turbine assembly 18 and a high pressure spool assembly seen generally at 20 which includes a shaft 25 interconnecting a high pressure compressor assembly 22 and a high pressure turbine assembly 24. The core casing 13 surrounds the low and high pressure spool assembly 12 and 20 in order to define a main fluid path (not numbered) therethrough. In the main fluid path there is provided a combustion section 26 having a combustor 28 therein.

Figure 2:
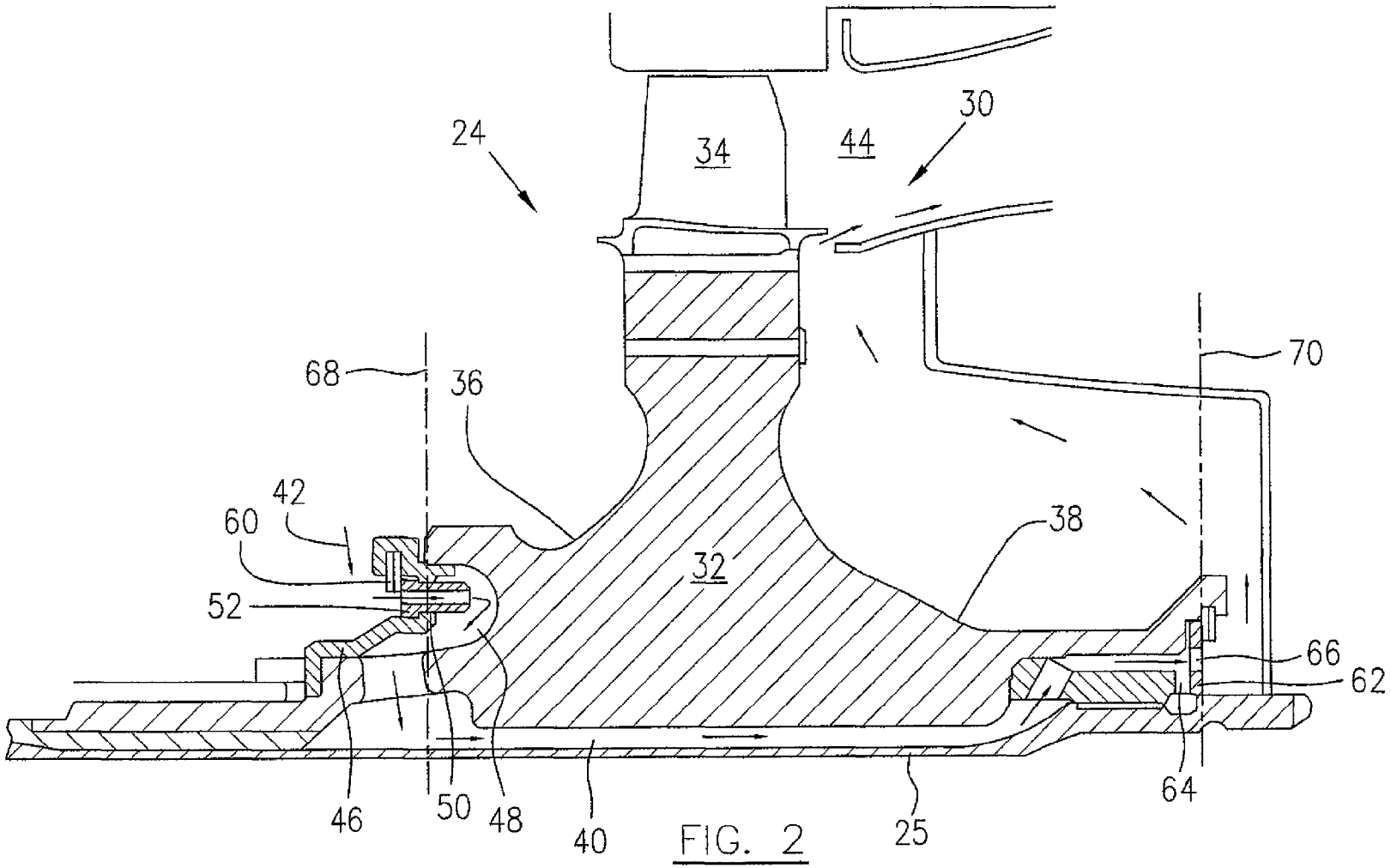
FIG. 2 is an enlarged partial cross-sectional view of the gas turbine engine of FIG. 1, showing a high pressure turbine rotor incorporating one embodiment of a balancing apparatus.

FIG. 2 shows, in cross-section, a rotor assembly 30 of the high pressure turbine assembly 24. The rotor assembly 30 includes a rotating disc 32 mounted to the shaft 25 to rotate together therewith. A plurality of uncooled blades 34 are attached to the rotating disc 32, extending radially outwardly from the disc 32. The disc 32 defines an opposed front and aft sides 36, 38 and a cooling air passage 40, for example defined by a central bore (not numbered) of the disc 32, extending between the front and aft sides 36 and 38 of the disc 32 for directing cooling air to pass therethrough to cool the disc 32. The cooling air passage 40 is in fluid communication with a supply of cooling air as indicated by numeral 42 located on the front side of the disc 32 and also in fluid communication with a section of the annular hot gas path 44 downstream of the blades 34 of the high pressure turbine rotor assembly 30.

Figure 3:
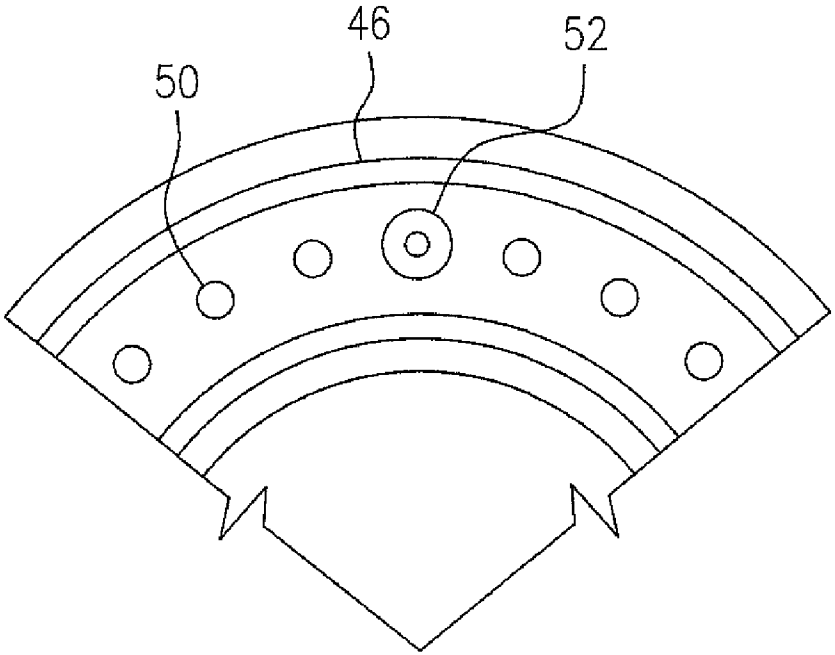
FIG. 3 is a partial front elevational view of an annular coverplate defining cooling holes therein to be mounted to a rotating disc of the rotor shown in FIG. 2.

An annular front coverplate 46 may be mounted to the front side 36 of the disc 32 to rotate together with the rotating disc. The annular front coverplate 46 is configured and cooperates with the disc 32 such that a cavity 48 is formed between the coverplate 46 and the front side 36 of the disc 32 and is in fluid communication with the cooling air passage 40. A plurality of cooling holes 50, as more clearly shown in FIG. 3 which are circumferentially spaced apart from one another, are provided in the coverplate 46, axially extending therethrough. Therefore, the cooling holes 50 are in fluid communication with both the supply of the cooling air 42 located at the front side 36 of the disc 32 and the cavity 48 between the coverplate 46 and the disc 32, thereby forming individual inlets (not numbered) of the cooling air passage 40 to introduce the cooling air to pass through the cooling air passage 40.

In a rotor balancing process according to one embodiment, a first step is to observe rotational imbalance of the rotor assembly 30, which is known in the art and will not be further described. As a result of the observation, a magnitude of imbalance caused by an eccentric rotation mass which is a function of the weight of the eccentric rotating mass and the radial distance of the mass from an axis of rotation, is determined. The angular direction of imbalance is also determined by the angular position of the eccentric mass relative to an arbitrary reference angular direction. The magnitude and angular direction of imbalance may be determined in a radial plane 68 normal to the engine rotating axis in which plane the cooling holes 50 of the coverplate 46 are substantially defined. Therefore, one or two or even more cooling holes 50 adjacent to the determined angular direction of imbalance may be selected for receiving balancing weights therein for balancing adjustment of the rotor assembly 30. The annular coverplate 46 is also configured and cooperates with a stationary structure (not numbered) to perform a seal function to maintain the supply of the cooling air 42 in appropriate pressure.

Figure 4:
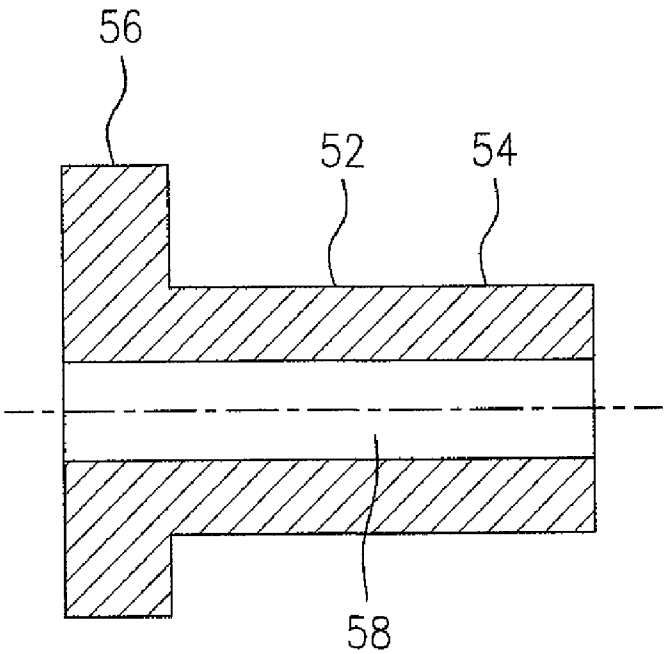
FIG. 4 is a cross-sectional view of a balancing weight used in the balancing apparatus of FIG. 2.

A plurality of balancing weights 52 (more clearly shown in FIG. 4) are provided for selective use in the rotor balancing process. The balancing weights 52 may have different mass quantities and at least one or more selected weights 52 may be attached to the selected one or more cooling holes 50 which were selected for addition of weights to balance the rotor assembly 30. The number of the cooling holes 50 selected to be used for attachment of the selected balancing weights 52 is significantly less than the total number of the circumferentially distributed cooling holes 50 in the annular coverplate 46. Therefore, the attachment of the selected balancing weights 52 to a few of selected cooling holes 50 in the annular coverplate 46 does not significantly interfere with the cooling of the rotor assembly 30 because the relatively large number of the remaining cooling air holes 50 which function as the inlets of the cooling passage 40, remains open.

The balancing weights 52 according to one embodiment may include a stem 54 extending axially from an enlarged head 56. The stem 54 has a diameter snugly fit in the individual cooling holes 50. Different masses for the individual balancing weights 52 may be achieved by varying the dimension of the head 56 or changing the axial length of the stem 54, or both. Optionally, the balancing weights 52 may define a central bore 58 axially extending therethrough such that when the stem 54 of the balancing weight 52 is inserted in a selected cooling hole 50, the central bore 58 of the balancing weight 52 allows the cooling air to pass therethrough, thereby preventing the selected cooling hole 50 which receives the balancing weight 52 from being blocked, resulting in less interference with the cooling of the rotor assembly 30. In alternate configurations, the weights may be provided in any suitable shape which provides cooling access through or past the weight, into the associated cooling passage.

Suitable means for securing the balancing weight 52 in the selected cooling hole 50 may be provided. For example, appropriate adhesive may be applied to the stem 54 of the balancing weight 52, the weight may be force-fit in the hole, mating threads may be provided to the respective stems 54 of the balancing weights 52 and the cooling holes 50 in the annular coverplate 46, or any other suitable method of attachment may be provided.

Optionally, a retainer such as a split ring 60 may be provided to retain one or more balancing weights 52 in position when the one or more balancing weights are inserted into selected cooling holes 50 of the annular coverplate 46. The split ring 60 is received in an annular groove defined in the annular coverplate 46 and abuts the enlarged head 56 of the one or more balancing weights 52 inserted in the selected cooling holes 50, thereby preventing the one or more balancing weights 52 from withdrawal from the selected cooling holes 50.

Alternatively, the above described balancing procedure using cooling holes in the rotor assembly 30 may also be applicable at the aft side 38 instead of at the front side 36 of the rotating disc 32. For example, an annular aft coverplate 62 may be mounted to the rotating disc 32 at its aft side 38. The annular aft coverplate 62 which may be configured differently from the annular front coverplate 46 depending on the specific configuration of the rotating disc, cooperates with the rotating disc 32 to form an annular cavity 64 between the annular aft coverplate 62 and the rotating disc 32 and is in fluid communication with the cooling air passage 40 of the rotor assembly 30. Similar to the annular coverplate 46, the annular aft coverplate 62 defines a plurality of circumferentially spaced cooling holes 66 in a radial plane 70 normal to the engine rotating axis. The cooling holes 66 are in fluid communication with the annular cavity 64 and therefore form as individual outlets (not numbered) of the cooling passage 40. The cooling holes 66 in the annular aft coverplate 62 may be used for selectively receiving one or more balancing weights 52 which are configured to fit with the size of the cooling holes 66, to perform the rotor balancing procedure as described above. The similar balancing process will not be redundantly described. The balancing weights used with the cooling holes 66 may be similar to or different from the balancing weights 52, and are not shown and further described.

It has been known that a static balancing process for a rotor involves balancing performance in one radial plane which is normal to the rotating axis of the rotor, such as the radial plane 68 in which the cooling holes 50 of the annular coverplate 46 are defined, or the radial plane 70 in which the cooling holes 66 of the annular aft coverplate 62 are defined. However, performing rotor balancing process in two radial planes which are normal to the rotating axis of the rotor and axially spaced apart from each other, such as the radial planes 68 and 70, may provide more desirable balancing results Therefore, a dynamic balancing process can be achieved by performing the above described rotor balancing process by using both cooling holes in the annular coverplate 46 and the cooling holes 66 in the annular aft coverplate 62, according to a further embodiment.

By employing cooling holes already provided in a disc assembly to retain balancing weights, additional features are not required on the disc assembly to retain weights. This simplifies the disc and minimizes stress concentrations, which may be beneficial where materials are used which are sensitive to stress concentrations, such an IN100 or ME16 superalloys.

The above description is meant to be exemplary only, and one skilled in the art will recognize that changes may be made to the embodiments described without departure from the scope of the invention disclosed. For example, the described apparatus and method may be applicable to rotors in a gas turbine engine different from the described and illustrated turbofan engine, and the rotor assemblies, particularly the rotating disc of the rotor assembly may be configured different from that described and illustrated in the described embodiments. Still other modifications which fall within the scope of the described subject matter will be apparent to those skilled in the art, in light of a review of this disclosure, and such modifications are intended to fall within the appended claims.

The invention claimed is:

1. An apparatus for balancing a gas turbine engine rotor assembly, the apparatus comprising:

one or more balancing weights each having a central aperture defined therethrough, the one or more balancing weights being inserted into selected one or more of a plurality of circumferentially spaced cooling holes defined in the rotor assembly, the number of selected cooling holes inserted with the one or more balancing weights being less than a total number of the cooling holes, to thereby assist in balancing the rotor assembly; and wherein the cooling holes are defined in a first coverplate of the rotor assembly, the first coverplate being configured and cooperating with a disc of the rotor assembly to define a cavity between the first coverplate and a first side of the disc, and the cavity being in fluid communication with a cooling air passage of the disc and the cooling holes of the first coverplate.

2. The apparatus as defined in claim 1 wherein the cooling holes communicate with a cooling passage defined through a bore of the rotor assembly.

3. The apparatus as defined in claim 2 wherein the rotor assembly includes a plurality of uncooled blades mounted thereto.

4. The apparatus as defined in claim 1 wherein the cooling holes are in direct fluid communication with a supply of cooling air for introducing the cooling air into the cooling air passage of the disc.

5. The apparatus as defined in claim 1 further comprising a second coverplate mounted to a second side of the disc, the second coverplate defining a plurality of circumferentially spaced cooling holes extending therethrough, the cooling holes of the second coverplate being in fluid communication with the cooling air passage of the disc for discharging the cooling air from the cooling air passage.

6. The apparatus as defined in claim 5, wherein the second coverplate comprises a second balancing weight selectively inserted into one of the cooling holes of the second coverplate.

7. The apparatus as defined in claim 6, wherein the second balancing weight defines an axial hole to allow the cooling air to pass therethrough.

8. The apparatus as defined in claim 1 further comprising a retaining device for securing the one or more balancing weights in the selected one or more cooling holes in the rotor assembly.

9. The apparatus as defined in claim 1 wherein the one or more balancing weights are selected from a plurality of balancing weights having different mass quantities, each having a stem extending from an enlarged head.

* * * * *